US006202795B1

(12) United States Patent
Bluteau

(10) Patent No.: US 6,202,795 B1
(45) Date of Patent: Mar. 20, 2001

(54) AUTOMATIC BRAKES FOR ELEVATOR CAR

(75) Inventor: Jean-Yves Bluteau, Soucelles (FR)

(73) Assignee: Thyssen Ascenseurs SAS, Angers (FR)

( * ) Notice: Subject to any disclaimer, the term of this patent is extended or adjusted under 35 U.S.C. 154(b) by 0 days.

(21) Appl. No.: 09/344,616

(22) Filed: Jun. 25, 1999

(30) Foreign Application Priority Data

May 5, 1999 (FR) ..... 99 05890

(51) Int. Cl.[7] ..... B66B 5/06
(52) U.S. Cl. ..... 187/288; 187/287
(58) Field of Search ..... 187/287, 288, 187/373, 410

(56) References Cited

U.S. PATENT DOCUMENTS 601,301 * 3/1898 Ihlder ..... 187/287
632,651 * 9/1899 Johnson ..... 187/287
1,182,240 * 5/1916 Bemis ..... 187/287
2,511,697 * 6/1950 Clift ..... 187/287
4,928,796 * 5/1990 Poon ..... 187/288

FOREIGN PATENT DOCUMENTS

404365771 * 12/1992 (JP) ..... 187/287

* cited by examiner

*Primary Examiner*—Jonathan Salata
(74) *Attorney, Agent, or Firm*—J. Warren Whitesel; Laff, Whitesel & Saret, Ltd.

(57) ABSTRACT

An automatic Braking system for an elevator car (10) is designed to stop it when it reaches or exceeds a speed limit of movement within an elevator shaft. A stop mechanism (40) is mounted on car (10), or a part thereof, so as to lock a stop pulley (41) which then moves relative to the car in a direction substantially parallel to the direction of the car (10) movement. A control mechanism (11) reacts to responsive to the stop pulley (41) movement to apply the brakes (12, 13).

6 Claims, 6 Drawing Sheets

AUTOMATIC BRAKES FOR ELEVATOR CAR

BACKGROUND

The present invention concerns a system for the automatic braking of an elevator car designed to stop it when it reaches or exceeds a limit speed of movement within a lift shaft.

Such automatic braking systems are already known which generally consist of a stop mechanism comprising a stop pulley designed to be driven in rotation at the same time as said car moves. Said stop pulley is designed to rotate freely when its speed of rotation is less than a threshold speed of rotation and to lock when its speed of rotation is equal to or greater than said threshold speed of rotation. They also comprise a mechanism for controlling the action of said brakes when said stop pulley is locked.

FIG. 1 shows an elevator installation equipped with a braking system according to the known state of the art. This installation consists essentially of an elevator car 10 which is moved between the different floors of an elevator shaft (not shown), for example by means of a machinery 20 acting on a cable or a cluster of traction cables 21 and having a counterweight 22. The elevator car 10 is guided in its movement by lateral rails extending vertically in the elevator shaft and on which the car 10 bears through guides 31. For reasons of clarity, only one of these rails 30 has been depicted in FIG. 1.

The elevator car 10 has a control mechanism 11 provided for controlling the action of the brakes 10 and 13 depicted here schematically in the form of simple wedges, The brakes 12 and 13 act generally on the rails 30 of the elevator car 10. These brakes 12 and 13 are also known in the art as "safety stop clamps". They act one in one direction of movement of the car 10, the other in the other direction.

As for the automatic braking system, this includes a stop pulley 50 which is mounted on the masonry in the top part of the elevator shaft and an endless cable 60 wound between the stop pulley 50 and a return pulley 51. The endless cable 60 is tensioned by means of a tension weight 52 acting on the return pulley 51.

A control mechanism 53 is fixed on the one hand to the endless cable 60 and on the other hand to the car 53. In normal operation, that is to say when the speed of movement of the car 10 is less than a limit speed, the car 10 drives the cable 60. The mechanism 53 is not stressed and therefore does not act on the control mechanism 11 of the brakes 12 and 13.

On the other hand, when the speed of the car 10 reaches or exceeds a limit speed, the stop pulley 50 locks and the cable 60 is immobilised. The mechanism 53 is stressed since it is on the one hand immobilised by the cable 60 and on the other hand fixed to the car 10, which is still moving. The effect of this stressing of the mechanism 53 is to actuate the control mechanism 11, which then acts on the brakes 12 and 13. These in return act on the rails 30, which has the effect of immobilising the car 10.

One of the drawbacks of the braking system of the state of the art presented above is its relatively large bulk because notably of the use of an endless cable, which has two parallel lengths for which it is necessary to reserve space in the elevator shaft.

The other drawback of this braking system lies in the fact that the stop pulley is necessarily mounted in the top part of the elevator shaft, generally on the same piece of masonry as that on which the drive motor 20 rests. The risks of accident related to this piece are therefore not covered by the braking system.

SUMMARY OF THE INVENTION

The aim of the present invention is to propose a braking system which does not have the drawbacks of the braking systems of the prior art, notably those disclosed above, and which is consequently more compact compared with those of the state of the art and which is not mounted on the same piece of masonry as that on which the drive motor rests.

To do this, according to one characteristic of the present invention, said stop mechanism is mounted on said car, said stop mechanism or part thereof being designed so as, in reaction to the movement of said car when said stop pulley is locked, to move relatively to said car in a direction substantially parallel to the direction of said car. Said control mechanism then acts on said brakes when said stop mechanism or said part thereof moves relatively to said car.

Advantageously, said stop pulley is driven by a control cable suspended vertically in the elevator shaft and passing through its groove.

According to a first embodiment of the present invention, said stop mechanism comprises two pulleys, one of which is said stop pulley, said control cable having its top vertical length passing through the bottom part of a first groove in one of said pulleys, then passing through the groove in the second pulley and then passing once again through the top part of the second groove in said first pulley.

Said first pulley can then constitute the part of the stop mechanism which, in reaction to the movement of said car when said stop pulley is locked, moves relatively to said car.

According to a second embodiment of the present invention, said stop mechanism comprises at least two pulleys, one of which is said stop pulley, said control cable passing through each of said grooves in said pulleys.

Said upstream pulley and said downstream pulley constitute the part of the stop mechanism which, in reaction to the movement of said car when said stop pulley is locked, moves relatively to the car.

According to another characteristic of the present invention, said stop mechanism or said part of said stop mechanism are mounted at the end of a pivoting arm, said arm, when moving away from its idle position, stressing the control mechanism, which then acts on said brakes.

According to another characteristic of the present invention, said stop mechanism or said part of said stop mechanism are mounted on channels extending substantially in the direction of movement of said car, said channel, moving away from its idle position, stressing the control mechanism, which then acts on said brakes.

According to another characteristic of the present invention, said stop mechanism or said part of said stop mechanism are provided with a retractable rod which can, when it is not retractable, come into contact with stops provided in said elevator shaft, which has the effect of moving said stop mechanism or said part of said stop mechanism relative to said car and to stress the control mechanism, which then acts on said brakes.

BRIEF DESCRIPTION OF THE DRAWINGS

The characteristics of the invention mentioned above, and others, will emerge more clearly from a reading of the following description of an example embodiment, said description being given in relation to the accompanying drawings, amongst which.

DETAILED DESCRIPTION OF INVENTION

Figure 2:
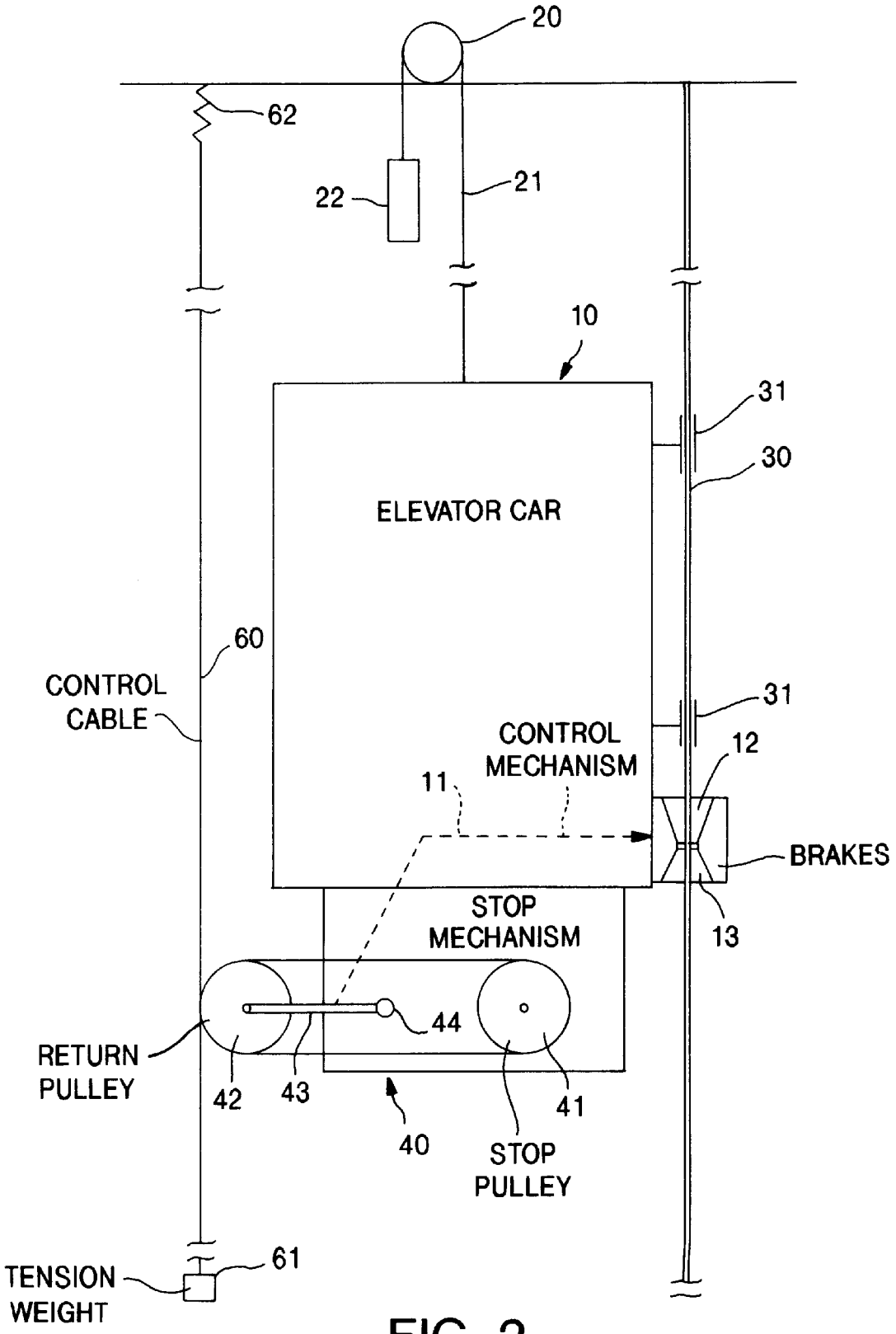
FIG. 2 is a schematic view of an elevator installation provided with an automatic braking system according to a first embodiment of the present invention, said arm, referred to as a stop mechanism, being situated in its idle position.

The elevator installation depicted in FIG. 2 consists essentially of an elevator car 10 which is moved between the different floors of an elevator shaft (not shown), for example by means of a machinery 20 acting on a traction cable or on a cluster of cables 21 and having a counterweight 22. This machinery 20 is for example mounted on the masonry constituting the top part of the elevator shaft.

The elevator car 10 is guided in its movement by lateral guides extending vertically in the elevator shaft. For reasons of clarity, only one of these rails 30 has been depicted.

The elevator car 10 has a control mechanism 11 (depicted schematically by a simple dotted line) designed to control the action of brakes 12 and 13 depicted schematically in FIG. 2 in the form of wedges. The brakes 12 and 13 act on the guides of the elevator car 10. These brakes 12 and 13 are also known in the art as "safety stop clamps". One of them acts in one direction of movement of the car 10, the other in the other direction.

The elevator car 10 has a stop mechanism 40 consisting here of a stop pulley 41 and a return pulley 42. The stop pulley 41 is of the type which turns freely as long as its speed of rotation does not exceed a threshold speed, and which locks when its speed of rotation exceeds said threshold speed of rotation.

It will be noted that in the example embodiment depicted the system 40 is mounted underneath the car 10, for example on the frame thereof. However, it will be understood, notably hereinafter, that it could be mounted, for example, on the same frame, in the top part of the car 10, or elsewhere provided that it is secured to the car 10.

A control cable 60, which extends vertically in the elevator shaft in which the said elevator car 10 moves, passes through the bottom part of a first groove in the return pulley 42, then passes through the groove in the stop pulley 41 in order to be able to drive it in rotation as the same time as the car 10 moves in the elevator shaft, and finally through the top part of a second groove in the return pulley 42. Its bottom end has a tension system such as a weight 61 (or a spring or the like), whilst its top end is connected to the roof of the shaft by means of an elastic system 62. The tension weight 61 and the elastic system 62 are designed to ensure the tension of the control cable 60.

In the example embodiment depicted in FIG. 2, the return pulley 42 is mounted so as to rotate freely at the free end of an arm 43 designed to pivot about a pivot axis 44. The stop pulley 41 and return pulley 42 have rotation axes parallel to each other and parallel to the pivot axis 44 of the arm 43.

The arm 43 acts on the control mechanism 11 as follows. When the arm 43 is in a substantially horizontal position, referred to as the idle position, such as the one depicted in FIG. 2, the control mechanism 11 is not stressed and the brakes 12 and 13 are inactive. On the other hand, when it takes an inclined position, referred to as the working position, in one direction or the other, the mechanism 11 is stressed, which has the effect of making the brakes 12 and 13 active, thus stopping the car 10 on its rails 30.

In normal operation, that is to say when the elevator car 10 does not exceed a limit speed, the cable 60 runs between the return pulley 42 and stop pulley 41, notably driving the latter. The arm 43 is then in its idle position, as depicted in FIG. 2. It therefore does not act on the control mechanism 11, so that the brakes 12 and 13 do not act on the rails 30.

It should be noted that the arm 43 can be acted on in this idle position, for example by means of elastic elements, such as springs (not shown).

When the elevator car 10 reaches and exceeds a limit speed, the speed of rotation of the stop pulley 41 becomes greater than its threshold speed of rotation. Consequently it locks, making it impossible for the control cable 60 to run through the stop mechanism 40. The return pulley 42 is then immobilised with respect to the control cable 60 and with respect to the shaft (except for the movement of the cable 60 permitted by the elastic means 62). In reaction to the advancement of the car 10 which, through inertia, is still moving, the arms 43 pivots about its pivot axis 44. The result is an action on the control mechanism 11, which has the effect of locking the brakes 12 and 13 on the rails 30. The elevator car 10 is then stopped.

The stop pulley 41 and return pulley 42 constitute together a stop mechanism 40 which therefore enables the movement cable 60 to run when its running speed is below a limit speed, which locks the control cable 60 when this limit speed is reached or exceeded. Moreover, the arm 43 constitutes a means allowing the movement of the stop mechanism 40 or a part of this mechanism 40 in the direction of travel of the car 10 when the control cable 60 is locked by the stop pulley 41, and the car 10, by inertia, still has movement.

It will be understood that the stop mechanism 40 could include a plurality of pulleys (at least two), where one would be a stop pulley 41 and at least one other would be mounted so as to be able to move in the direction of travel of the car, for example at the end of an arm such as the arm 43.

Advantageously, it is the upstream pulley (the one which receives the top vertical length) and the downstream pulley (the one which returns the bottom vertical length) which are mounted so as to be able to move in the direction of travel of the car 10.

Figure 3:
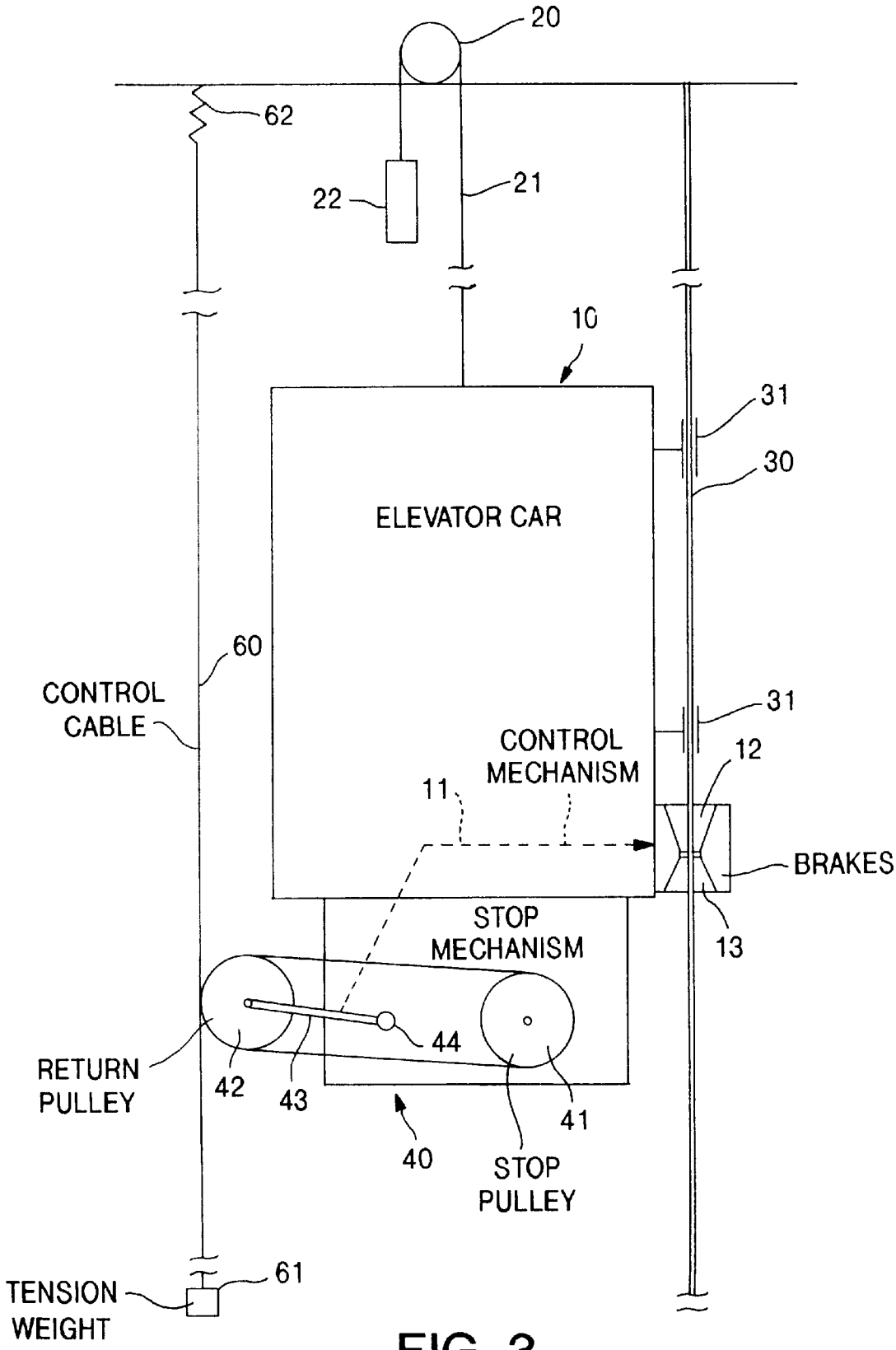
FIG. 3 is a schematic view of an elevator installation provided with an automatic braking system according to a first embodiment of the present invention, said arm, referred to as a stop mechanism, being situated in a working position.

In FIGS. 2 and 3, the return pulley 42 is a pulley with two grooves designed on the one hand to receive the top vertical length of the cable 60 and to return it to the stop pulley 41 and on the other hand to receive the length issuing from the stop pulley 41 and to return it as a bottom vertical length.

Figure 1:
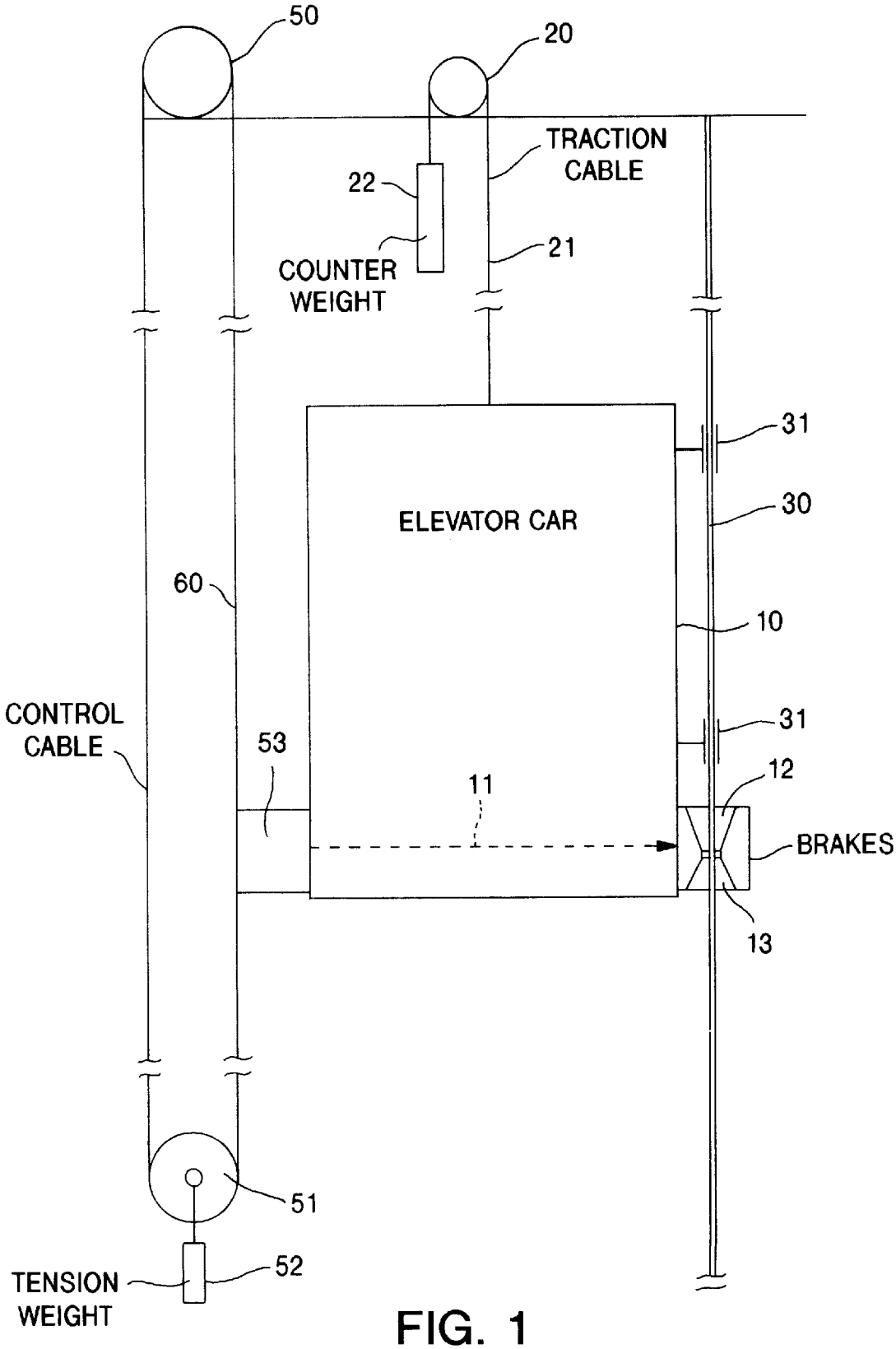
FIG. 1 (PRIOR ART)
FIG. 1 is a schematic view of an elevator installation provided with an automatic braking system according to the state of the art.
Figure 4:
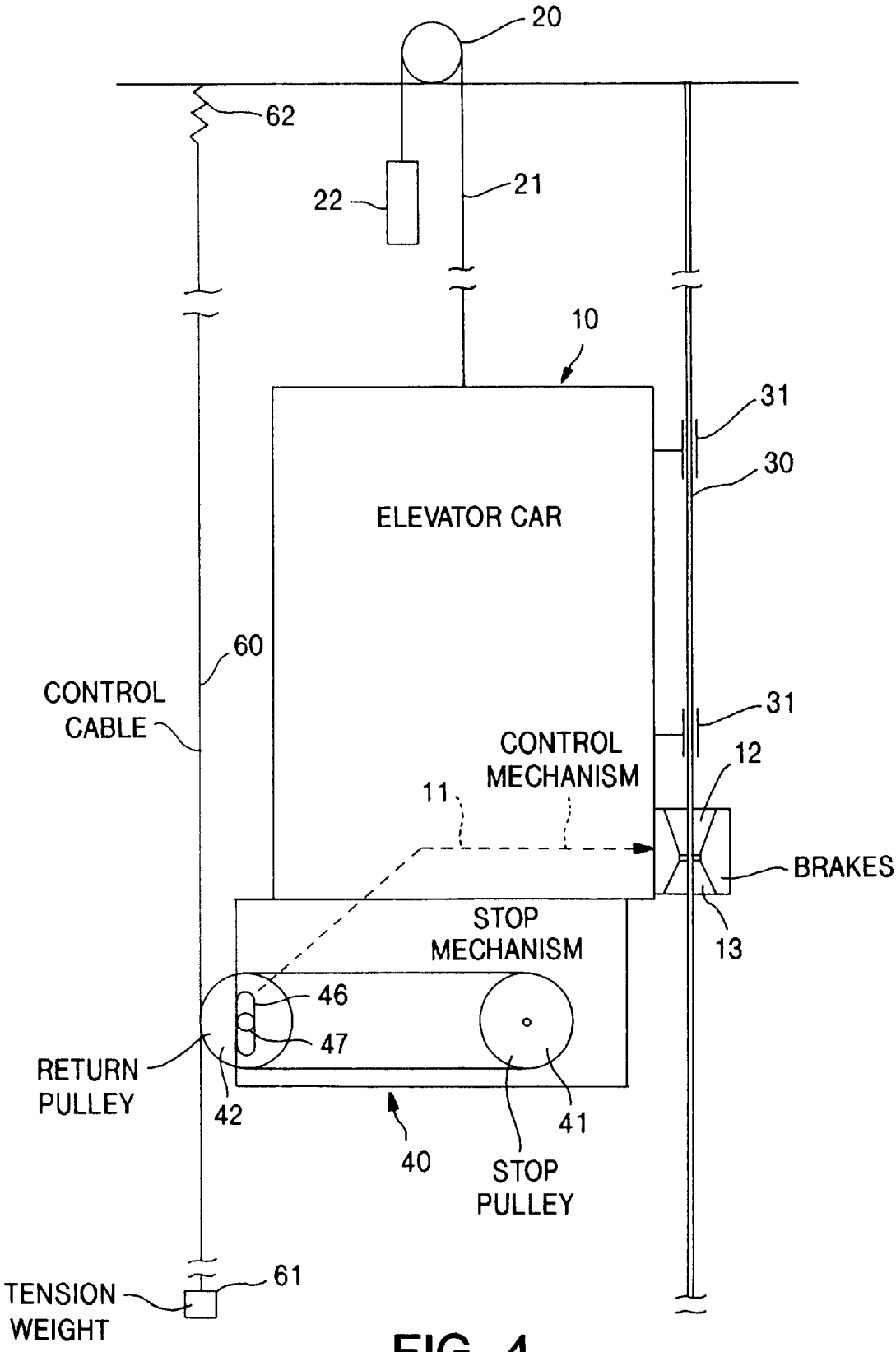
FIG. 4 is a schematic view of an elevator installation provided with an automatic braking system according to the second embodiment of the present invention.

FIG. 4 depicts a variant embodiment where the arm 43 depicted in FIGS. 1 and 2 is replaced by a channel 46 parallel to the direction of travel of the car 10 in which the rotation axis 47 of the return pulley 43 can move when the control cable 60 is locked in the stop pulley 41. In FIG. 4, the return pulley 42 is depicted in its idle position in which the rotation axis is substantially at the centre of the channel 46. The mechanism 11 is stressed when the axis 47 is no longer in its central idle position, but is separated therefrom.

Figure 5:
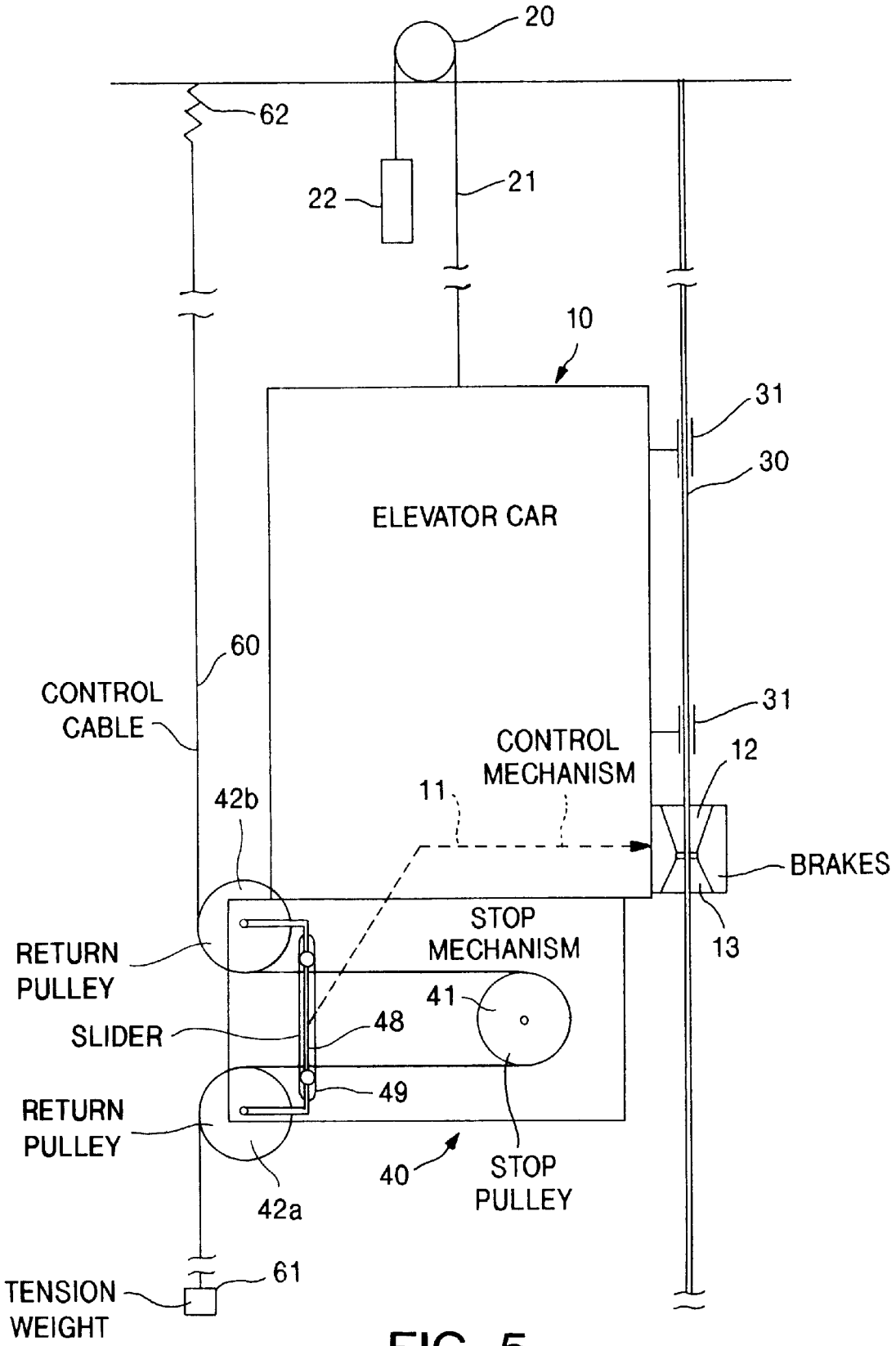
FIG. 5 is a schematic view of an elevator installation provided with an automatic braking system according to the third embodiment of the present invention.

FIG. 5 is a variant embodiment which has two return pulleys 42*a* and 42*b* which are mounted so as to be free to rotate at the ends of a slider 48 designed so as to be able to move in translation in a direction parallel to the direction of movement of the elevator car 10. The slider 48 is for this purpose mounted in a channel 49 extending vertically in the direction of travel of the car 10. The slider 48 is here shown in its idle position.

It should be noted that the embodiments depicted are designed to trigger the action of the brakes 12 and 13 when the car 10 reaches or exceeds a limit speed fixed by the stop pulley 41, whatever the direction of movement of the car 10.

It will have been understood that, in all the examples depicted, the stop pulley 41 could be put in place of a return pulley 42, 42*a* or 42*b*, and that it would then be replaced by a return pulley.

Figure 6:
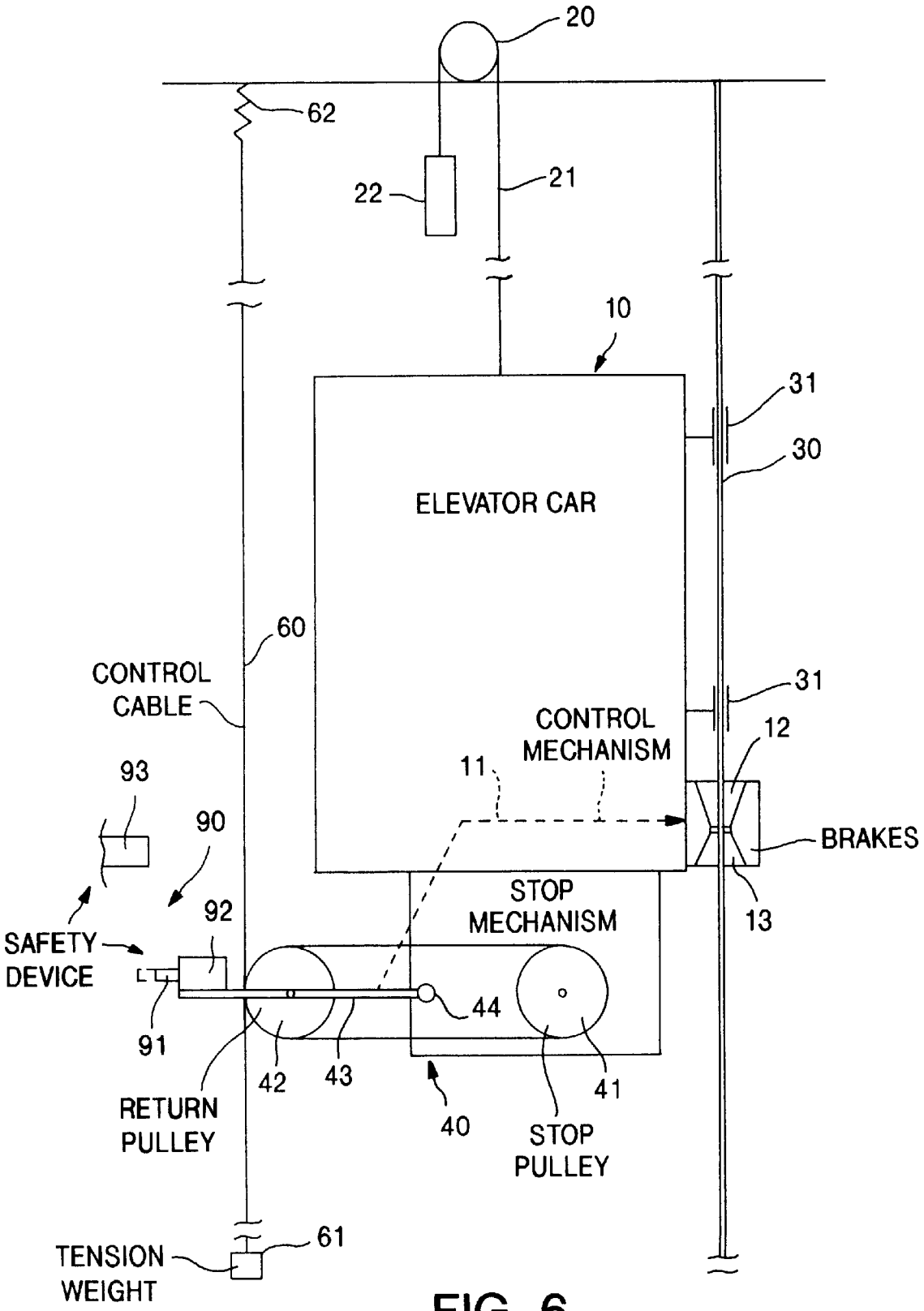
FIG. 6 is a schematic view of an elevator installation which is identical to that of FIG. 2 and which also has a safety device.

In FIG. 6 an elevator installation is shown which is identical to that which is already depicted in FIG. 2 and which also has a safety device 90. This safety device 90 consists essentially of a rod 91 which is retractable under the action of a control device such as an electromagnetic 92, which is mounted on the pivoting arm 43. In FIG. 6, the retractable position of the rod 91 is depicted in bold lines, whilst its deployed position is depicted in dotted lines.

When the rod 91 is in the non-retracted position, it can come into contact with one or more stops 93 which are provided in the elevator shaft. On the other hand, in the retracted position, it can no longer come into contact with these stops 93.

When the rod 91 comes into contact with a stop 93 by reaction to the travel of the car 10, the arm 43 pivots on its axis, which has the effect of acting on the control mechanism 11 and actuating the brakes 12 and 13. The car is the immobilised.

What is claimed is:

1. A system for automatically braking an elevator car (1), said system comprising brake means (12, 13) on the car (10) which operate when said car reaches or exceeds an allowable speed limit in response to movement inside an elevator shaft;

a control cable (60) suspended vertically in said elevator shaft;

stop means (40) mounted on said car (10), said stop means comprising at least two pulleys (41, 42, 42*a*, 42*b*) having circumferential grooves, said control cable (60) passing through said grooves, one of said pulleys (41) being a stop pulley (41), control means responsive to a speed of rotation of said stop pulley being less than a threshold speed of rotation, for enabling said stop pulley to turn freely at the same time that said car (10) moves inside said elevator shaft, and said control means locking said stop pulley when its speed of rotation is equal to or greater than said threshold speed of rotation, another of said pulleys (42, 42*a*, 42*b*) being loose pulleys, at least one of said loose pulleys being responsive and reacting to the movement of said car (10) when said stop pulley (41) is locked, said other pulley moving relative to said car and in a direction substantially parallel to the direction of said car (10), and control means (11) for applying said brakes (12, 13) when said other loose pulley (42, 42*a*, 42*b*) moves relative to said car (10).

2. The braking system of claim 1, wherein said stop means (40) comprises two pulleys (41, 42), one of which is said stop pulley (41), said control cable (60) having an upper vertical length passing through a bottom part of a first groove in said other pulley (42), then passing through a groove in said stop pulley (41) and then passing once again through an upper part of a second groove in said other pulley (42).

3. The braking system of claim 1, wherein said stop means (40) comprises three pulleys, one of said three pulleys being said stop pulley (41), the other of said three pulleys being loose pulleys (42*a*, 42*b*) respectively in upstream and downstream positions relative to the stop pulley (41), both said upstream pulley (42*a*) and said downstream pulley (42*b*) moving relative to said car motion and in a direction substantially parallel to the direction of said car (10), said upstream and downstream pulleys being responsive to the movement of said car (10) when said stop pulley (41) is locked.

4. A braking system according to one of the claims 1 or 3, wherein at least one of said loose pulleys moves relative to said car and in a direction substantially parallel to the direction of said car (10), said at least one loose pulley being mounted at an end of a pivoting arm (43), said arm (43) moving away from an idle position, and stressing the control means (11), and means responsive to said control means for applying said brakes (12, 13).

5. A braking system according to one of claims 1 or 2, wherein at least one of said loose pulleys moves on channels relative to said car in a direction substantially parallel to the direction of said car (10) and on channels (46, 49) extending substantially in the direction of movement of said car (10), in moving away from its idle position, said at least one loose pulley stressing the control mechanism (11), and means responsive to said control means for applying said brakes (12, 13).

6. A braking system according to one of claims 1 or 2, wherein at least one of loose pulleys moves relative to said car in a direction substantially parallel to the direction of said car (10), and a retractable rod (91) which, when not retracted, comes into contact with at least one stop (93) provided in said elevator shaft, means responsive to said contact between said rod and one stop for said control means (11) and means responsive to said control means for applying said brakes (12, 13).

* * * * *